US005188412A

United States Patent [19]

Maier

[11] Patent Number: 5,188,412

[45] Date of Patent: Feb. 23, 1993

[54] MODULAR RECYCLING CONTAINER

[76] Inventor: Friedrich Maier, Weikersbergstrasse 71, D-7923 Königsbronn-Zang, Fed. Rep. of Germany

[21] Appl. No.: 575,002

[22] Filed: Aug. 29, 1990

[51] Int. Cl.[5] ..... B65D 51/00; B65F 1/12

[52] U.S. Cl. ..... 294/68.24

[58] Field of Search ..... 294/68.1-68.3; 220/1.5, 23.2, 23.4, 23.83, 255, 260, 314, 315, 324, 334, 601, 660, 661, 669, 670, 676, 908; 414/403, 404, 407, 411, 414

[56] References Cited

U.S. PATENT DOCUMENTS

| | | | |
|---|---|---|---|
| 559,797 | 5/1896 | Greene | 294/68.24 |
| 1,411,453 | 4/1922 | Nolan | 294/68.24 X |
| 1,645,259 | 10/1927 | Smith | 294/68.24 |
| 1,809,640 | 6/1931 | Showers | 294/68.24 |
| 1,955,346 | 4/1934 | Sherman | 294/68.24 |
| 1,966,199 | 7/1934 | Coffey | 294/68.24 X |
| 2,063,650 | 12/1936 | Woodruff | 294/68.24 |
| 2,381,103 | 8/1945 | Briner | 294/68.24 |
| 2,384,389 | 9/1945 | Moore | 294/68.24 |
| 2,801,126 | 7/1957 | White et al. | 294/68.24 X |
| 3,797,878 | 3/1974 | Fagre et al. | 294/68.24 X |

FOREIGN PATENT DOCUMENTS

| | | | |
|---|---|---|---|
| 214035 | 4/1924 | United Kingdom | 294/68.24 |
| 1365641 | 9/1974 | United Kingdom | 294/68.24 |

*Primary Examiner*—Johnny D. Cherry
*Attorney, Agent, or Firm*—Beaton & Swanson

[57] ABSTRACT

A modular recycling container is disclosed. The container is hoistable, stable, relatively animal-proof, weather-tight, lightweight, inexpensive, and capable of modular clustering. The container may be hexagonal or roughly cylindrical on one horizontal axis with a flattened base. The container is fabricated from a lightweight plastic material such as fiberglass reinforced polyester. The container includes a hoisting attachment and a trap door bottom so that the doors on the hoisted container can be opened to release the contents into a larger container such as a truck.

7 Claims, 4 Drawing Sheets

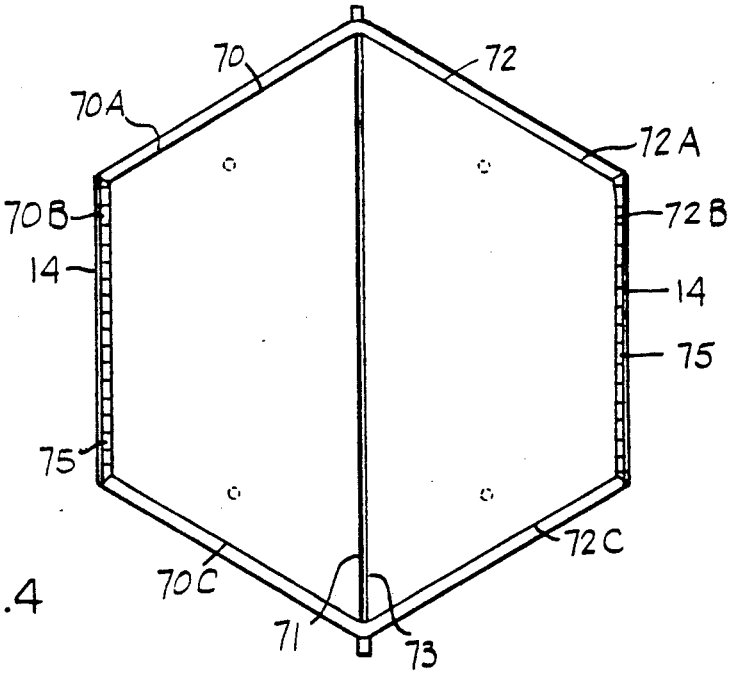
FIG.4
FIG.5
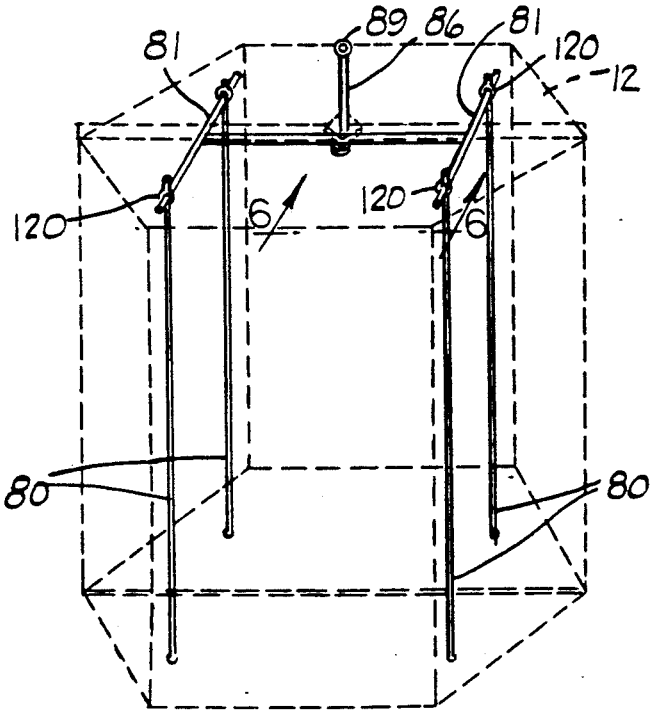
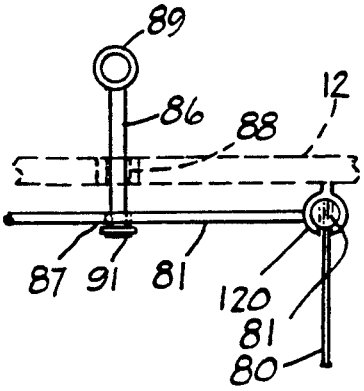
FIG.6

MODULAR RECYCLING CONTAINER

BACKGROUND OF THE INVENTION

Increasing attention has been directed in recent years to the recycling of glass, paper, metal and other disposable packaging as the cost of producing and disposing of the packaging has escalated. In addition, increased awareness of the environmental and aesthetic impact of disposable products had led to government regulation or economic incentives to encourage recycling.

Recycling of household materials on a wide basis is relatively uncommon in the United States. Although some communities regularly recycle newspaper and aluminum cans by individual households, they are the exception. Even those communities that recycle household newspaper and aluminum cans tend to do so sporadically rather than systematically, and they rarely recycle other household materials such as glass.

This lack of systematic and comprehensive recycling programs is attributable in part to a lack of appropriate recycling equipment. Ideally, recycling containers should have a combination of characteristics that are not found in existing container technology. They should be closed so that fumes are relatively contained and so that weather and animals cannot access the interior. They should be readily fillable so that the recycling consumer is at ease in operating them. They should be easily emptied, preferably by utilizing common hoisting and dumping techniques. They should be light-weight in order to be hoisted with a minimum of hoisting capability. They should be inexpensive to manufacture.

The exterior configuration of the recycling containers is also important. The exterior should be, in addition to aesthetically pleasing, of a size and shape that allows the containers to be clustered together into a component grouping of several containers for several different types of material. The overall container should be stable when the container is either empty or full or at any stage in between. The exterior surface should be such that it will permanently take printed labeling and instructions.

Ordinary trash containers are deficient in many of these respects. A typical dumpster is too large and unsightly for most neighborhood applications, is not easy to use for children or small adults, is not weathertight or animal proof, is odiferous, and cannot be conveniently and orderly clustered with similar containers for other recycling materials. At the other extreme in size, ordinary trash cans are too small for most applications, cannot easily be hoisted or dumped and, like dumpsters, do not lend themselves to convenient, orderly and stable clustering.

SUMMARY OF THE INVENTION

The present invention is a modular recycling container that is hoistable, stable, relatively animal-proof and weather-tight, lightweight, inexpensive, and capable of modular clustering.

One embodiment of the invention is hexagonal when viewed from the top. The hexagonal shape allows the container to stand unsupported in a stable manner, and also allows a plurality of containers to be clustered together in a highly stable, convenient and orderly modular fashion for the recycling of several different materials at a single location.

The containers are fabricated from a lightweight plastic material such as fiberglass reinforced polyester. The exterior surface readily takes printed instructions and labeling and can be painted any color to facilitate color-coding or aesthetic attractiveness.

The containers include hoisting attachment means such as a hook or ring affixed to the top surface to allow hoisting. Each container has a trap door bottom operable from operating means on the top surface or elsewhere on the container so that the doors on the hoisted container can be opened to release the contents into a larger container such as a truck.

BRIEF DESCRIPTION OF THE DRAWINGS

FIG. 4 shows a bottom plan view of the container of FIG. 1.

FIG. 5 shows a perspective view of the container of FIG. 1, showing the door operating mechanism and showing the container in phantom.

FIG. 6 shows a sectional view taken along line 6—6 of FIG. 5.

DETAILED DESCRIPTION OF THE PREFERRED EMBODIMENTS

Figure 1:
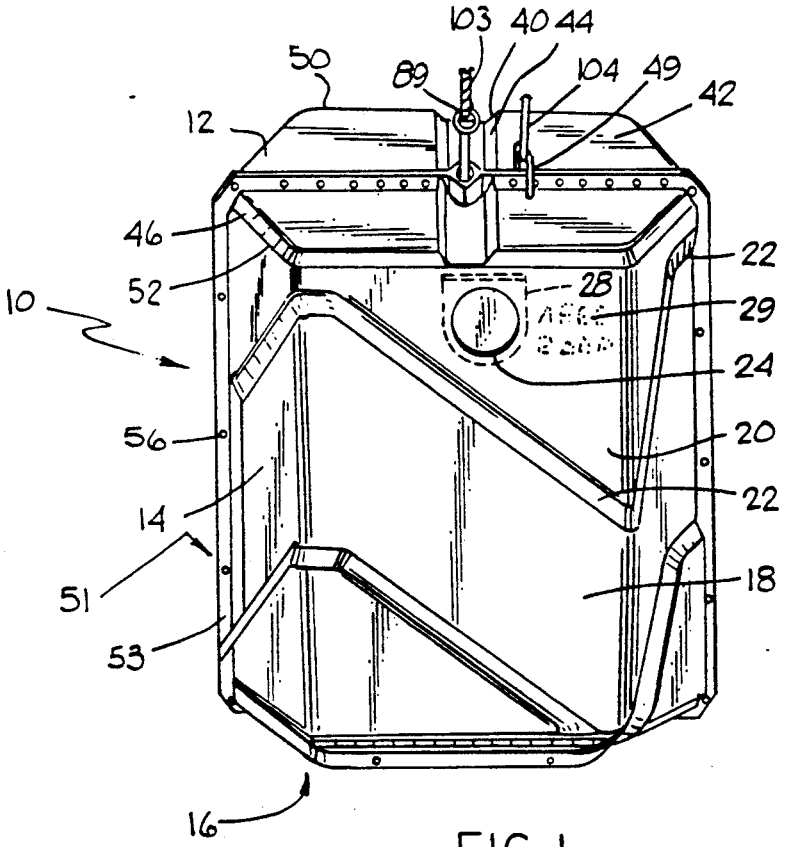
FIG. 1 is a perspective view of a preferred embodiment container of the present invention.

FIG. 1 shows a perspective view of a preferred embodiment of the invention. The invention consists of a container 10 with an upper surface 12, six side panels 14, and a trap door assembly 16. The sides 14 may have recessed portions 18 which interface with the unrecessed portions 20 through beveled portions 22, thereby enhancing the strength and rigidity of the container.

In at least one of the side panels 14 is an opening 24 to receive recycled materials. Preferably, the opening 24 is shaped to correspond approximately to a cross-section of the recycled material. In the example shown in FIG. 1, the opening 24 is round to correspond to the round radial cross-section of a recycled bottle or can. A container for use in recycling paper may have an elongated slot for an opening, and other opening shapes and sizes may be chosen for desired recycled materials. The opening may be covered by a flexible or hinged flap 28 attached to the container side 14 above the opening 24 and gravity-held to cover the opening.

One or more of the side panels 14 may be printed with an identification 29 of the recycled materials which the container 10 is intended to receive and the instructions for use of the container. The recycled material identification may include graphics that are understandable to children or illiterates.

The upper surface 12 of the container 14 may include a recessed portion 40 integrally joined to an unrecessed portion 42 through a bevelled portion 44. The upper surface 12 joins the side panels 14 through other bevelled surfaces 46 so that there are no sharp corners between the upper surface 12 and the side panels 14. A hoisting loop 49 is attached to the upper surface 12 in the vicinity of the central portion for hoisting the container 10.

Figure 2:
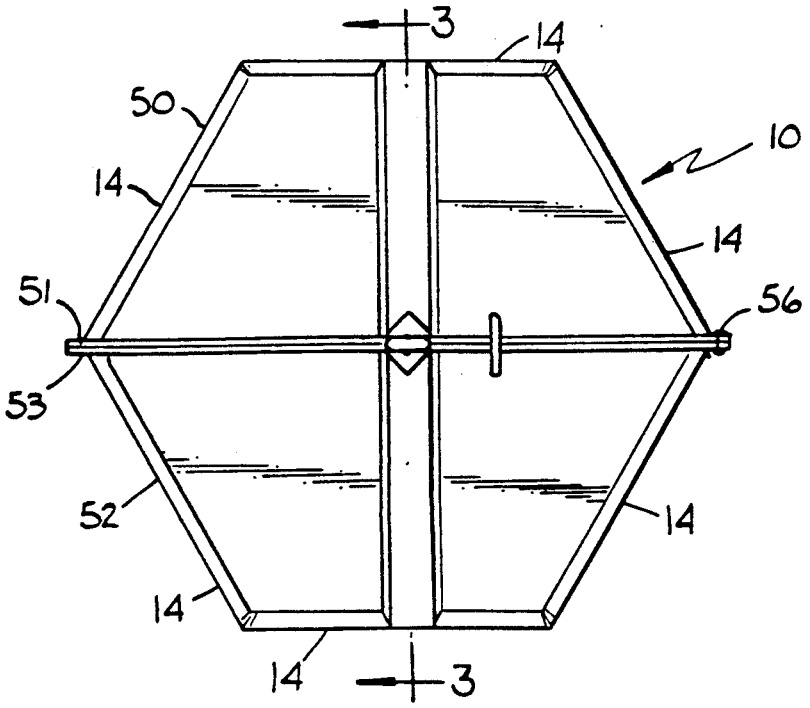
FIG. 2 shows a top plan view of the container of FIG. 1.

As shown in FIG. 2, the upper surface 12 and six side panels 14 are formed from a left side 50 and a right side 52. Each of the sides 50 and 52 is substantially the same, and includes three side panels 14 and half of the upper surface 12. The two sides 50 and 52 have flanges 51 and 53, respectively, at the edges of their upper surface 12 and three side panels 14. The flanges 51 and 53 are joined with rivets 56, adhesive or other suitable attachment means. The interior surface of the container 10 may be treated with a flame retardant (not shown) to help prevent combustion of the recycled materials.

Figure 3:
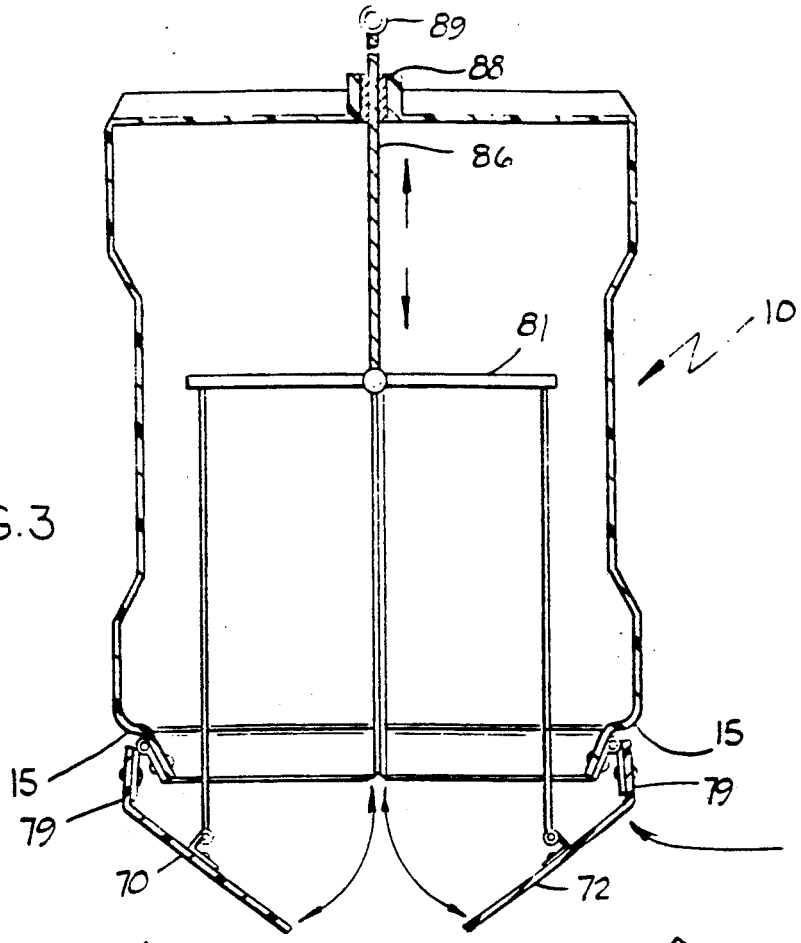
FIG. 3 shows a sectional view taken along line 3—3 of FIG. 2.

The bottom of the container 10 has a door assembly 16 fitted with two mating doors 70 and 72, as shown in FIG. 3 and FIG. 4. Each door 70 and 72 has three perimeter edges 70A, 70B and 70C and 72A, 72B and 72C corresponding to the three side panels 14 to which it fits, and a long edge 71 and 73, respectively. The middle perimeter sides 70B and 72B are hingedly connected to a side panel 14 with a hinge 75. This allows the doors 70 and 72 to mate together at the long edges 71 and 73 to close the bottom of the container 10 in one hinge position, and to release to open the container 10 by opening at the long edges 71 and 73 in a second hinge position. The bottom edges of the side panels 14 are bevelled and recessed 15 to mate with upstanding lips 79 of the doors 70 and 72.

The doors 70 and 72 are operated by cabling as shown in FIG. 3 and FIG. 5. Four cables 80 are attached to the interior surfaces of the doors 70 and 72 and the other ends of the cables are attached to an H-shaped cable carrier 81. The cable carrier 81 is slidably attached to a cable plunger 86 which extends from the cable carrier 81 up to the upper surface 12 of the container 10 and slidably through the upper surface 12. A bushing 88 may be provided in the upper surface 12 to facilitate the operability of the cable plunger 86 as it slides through the upper surface 12. The top of the cable plunger 86 terminates outside the container 10 with an eyelet 89.

Figure 7:
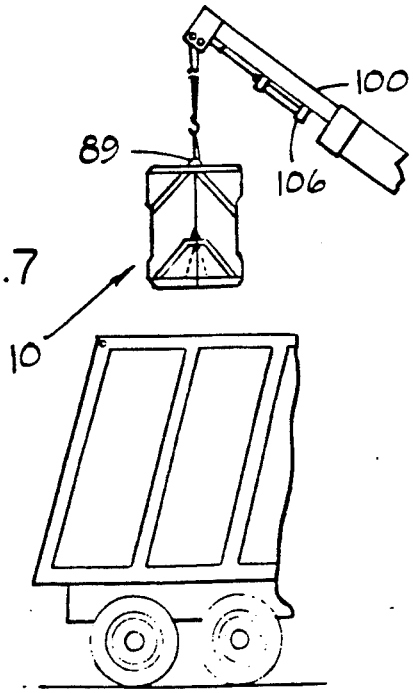
FIG. 7 shows the container of FIG. 1 hoisted for emptying into a collection container.
Figure 8:
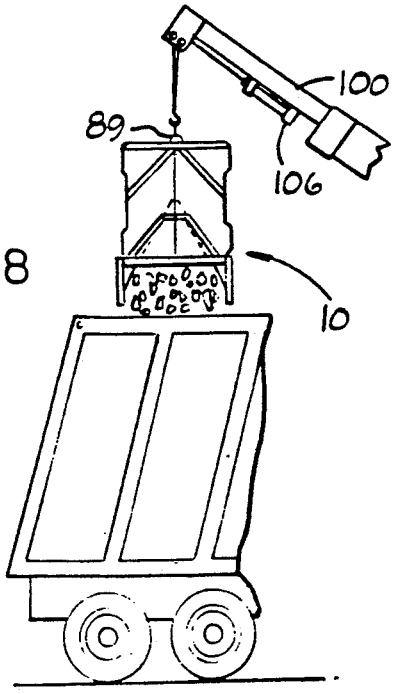
FIG. 8 shows the container of FIG. 1 hoisted over a collection container for emptying, with the trap doors in the lower surface opened for discharge of the contained materials.

It can be seen from FIG. 7 and FIG. 8 that the container 10 may be hoisted with a crane 100 or boom by a first hoisting line 103 attached to the plunger eyelet 89. At the same time, a second hoisting line 104 is releasably attached to the hoisting eyelet 49. The other end of the first hoisting line is attached to a dumping actuator 106. When the container 10 is positioned over the dumping area as desired, the dumping actuator 106 actuates to slacken the first hoisting line 103. This causes the weight of the container and its contents to shift to the second hoisting line 104. The slackening of the first hoisting line 103 allows the weight of the recycled material in the container 10 to urge the doors 70 and 72 open as the door cables 80 draw the cable carrier 81 downward and the cable plunger 86 downward through the upper surface 12. If desired, the doors 70 and 72 can be opened slowly to control the dumping rate by adjusting the actuation speed of the cable actuator 106.

When the recycled materials have been completely discharged from the container 10, the dumping actuator 106 actuates again to take up the tension in the first hoisting line 103. This causes the cable plunger 86 to move upward through the upper surface 12, thereby pulling shut the doors 70 and 72 with the cable carrier 81 and cables 80.

An important element to the embodiment shown in FIG. 1 is the mechanism for controlling the cable carrier shown in FIG. 5 and FIG. 6. Four cable carrier spring clips 120 are mounted to the interior surface of the upper surface 12 of the container 10. The cable plunger 86 is slidably attached through the cable carrier 81 through a hole 87 in the cable carrier 81. The cable plunger 86 is retained in the cable carrier 81 by a stop 91 attached to the lower end of the cable plunger 86.

In operation, the cable carrier 81 is normally held to the top surface 12 by the four cable carrier spring clips 120. This positioning of the cable carrier 81 prevents any of the recycled material from accumulating on top of the cable carrier 81 as the container 10 is filled. In the absence of the cable carrier spring clips 120 or some other means to secure the cable carrier 81 to the upper portion of the container interior, the material accumulated on top of the cable carrier 81 would prevent the cable carrier from moving upward to hold the doors 70 and 72 closed as the container is hoisted. This would allow the doors 70 and 72 to open immediately and prematurely as soon as the container 10 is lifted from the ground. The slidable attachment of the cable plunger 86 through the cable carrier 81 allows the cable plunger 86 to rest in a plunged configuration when the container 10 is on the ground, so that the hoisting eyelet 89 does not protrude unnecessarily and dangerously from the upper surface 12. As the hoisting takes place, the weight of the container 10 against the first hoisting cable 103 causes the cable plunger to withdraw from the top surface and receive the weight of the container.

When the container is in position to be dumped, and the first hoisting line 103 is slackened while the weight of the container transfers to the second hoisting line 104 as described above, the cable carrier 81 slips out of the grasp of the cable carrier clips 120. This thereby allows the cable carrier 81 to move downward and the doors 70 and 72 to open.

Figure 9:
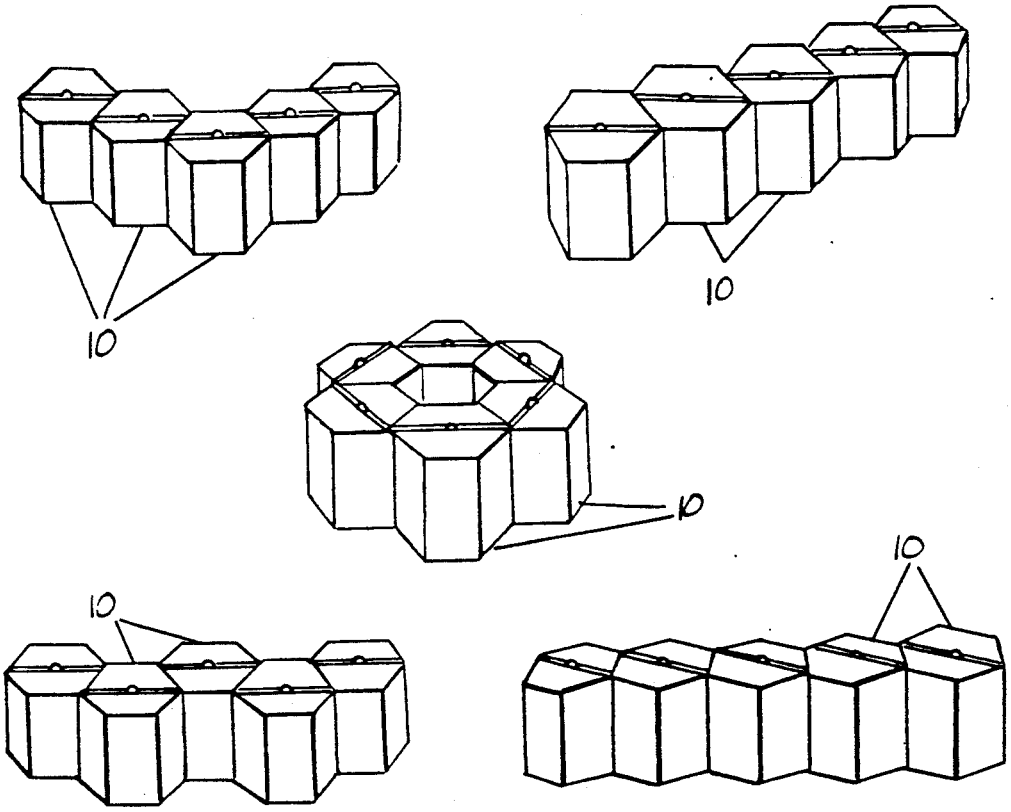
FIG. 9 shows several clusters of containers of the embodiment of FIG. 1.

FIG. 9 shows the favorable clustering feature of the preferred embodiment of FIG. 1. It can be seen that the hexagonal shape of this preferred embodiment lends itself to a stable and orderly arrangement of several containers by positioning them side by side. The advantages of each of these arrangements are that they are stable because each container is in contact with at least one other container, the opening to each container is accessible without being obstructed by the side of any container with which it is in contact, the entire arrangement is compact so that it occupies little space, all the containers can be hoisted one by one by a hoist in a single position if desired, and the clustered arrangement presents an ordered appearance that is pleasing to the eye.

What is claimed is:

1. A recycling container comprising:

(a) a top with a peripheral edge; and a plurality of side panels with top edges and bottom edges, the side panel top edges being attached to said top peripheral edge, and whereby the bottom edges define a bottom opening in the container;

(b) a first door having a first edge being hingedly attached to the bottom edge of a first side panel, and a second edge being substantially opposite said first door first edge, and at least one other edge extending between said first door first and second edges;

(c) a second door with a first edge being hingedly attached to the bottom edge of a second side panel on substantially the opposite side of the container from the first side panel, said second door having a first edge being hingedly attached to the bottom edge of said second side panel, and a second edge being substantially opposite said second door first edge, and at least one other edge extending between said second door first and second edges;

(d) a plunger slidably extending through said top, a first cable with one end attached to the first door and a second cable with one end attached to said second door and a cable carrier attached to said plunger, said cable carrier having sides extending away from said plunger and toward said side panels, and the other ends of said cables being attached to said cable carrier sides; and (e) spring clips mounted to the top for clipping to the cable carrier for releasably attaching said cable carrier to the top of said container, whereby said cable carrier contacts and is held by said spring clips when the plunger and cable carrier are raised relative to the container by hoisting the container, and said cable carrier releases from said spring clips when the doors draw the plunger and cable carrier downward relative to the container when the container contents are dumped.

2. The container of claim 1, wherein said side panels include recessed portions for improving the strength and rigidity of the container.

3. The container of claim 1, wherein the container includes six side panels of substantially equal size and shape having vertical edges and being joined at their vertical edges so that the top view shape of the container is hexagonal.

4. The container of claim 3, wherein at least one of said side panels has an opening just large enough to receive the material to be recycled.

5. The container of claim 4, wherein said plurality of side panels includes a first group of side panels and a second group of side panels, and said top and plurality of side panels form:

(a) a first container half comprising said first group of side panels and half of said top and having at least two vertical edges and a horizontal edge; and (b) a second container half comprising the second group of side panels and other half of said top and having at least two vertical edges and a horizontal edge, said second container half being attached to said first container half along said vertical edges and horizontal edges.

6. The container of claim 5, further comprising:

(a) a first container half flange attached to and extending along said first container half vertical edges and horizontal edge; and (b) a second container half flange attached to and extending along said second container half vertical edges and horizontal edge, whereby the attachment of said first container half to said second container half is by attachment of said first container half flange to said second container half flange.

7. The container of claim 6, further comprising openable closure means for said opening in said one side panel, said means being attached to said one side panel.

* * * * *